US005121939A

United States Patent [19]

Peyre

[11] Patent Number: 5,121,939

[45] Date of Patent: Jun. 16, 1992

[54] SAFETY TOE UNIT FOR A SKI BINDING

[75] Inventor: Henri Peyre, Saint Benin D'Azy, France

[73] Assignee: Look, S.A., Nevers cedex, France

[21] Appl. No.: 620,234

[22] Filed: Nov. 29, 1990

[30] Foreign Application Priority Data

Dec. 1, 1989 [DE] Fed. Rep. of Germany ..... 3939883

[51] Int. Cl.[5] ..... A63C 9/08

[52] U.S. Cl. ..... 280/634; 280/625; 280/626; 280/629; 280/631

[58] Field of Search ..... 280/623, 625, 626, 628, 280/629, 633, 634, 631, 632

[56] References Cited

U.S. PATENT DOCUMENTS

| | | | |
|---|---|---|---|
| 4,166,636 | 9/1979 | Svoboda et al. | 280/625 |
| 4,682,786 | 7/1987 | Peyre | 280/628 |
| 4,979,762 | 12/1990 | Gallet | 280/625 |

FOREIGN PATENT DOCUMENTS

| | | | |
|---|---|---|---|
| 712491 | 6/1965 | Canada | 280/625 |
| 2637870A1 | 3/1978 | Fed. Rep. of Germany . | |
| 2916348A1 | 8/1979 | Fed. Rep. of Germany . | |
| 364630 | 11/1981 | Fed. Rep. of Germany . | |
| 3041545 | 10/1982 | Fed. Rep. of Germany | 280/625 |
| 372864 | 11/1983 | Fed. Rep. of Germany . | |
| 2624752 | 6/1989 | France | 280/634 |
| 2628647 | 9/1989 | France . | |

*Primary Examiner*—Eric D. Culbreth
*Attorney, Agent, or Firm*—Townsend & Townsend

[57] ABSTRACT

A safety toe unit for a ski binding comprises a base body (11) which is to be secured to the ski, with a sole holder (13) which holds an inserted ski boot from above and from the sides being upwardly pivotally mounted on the base body about a transverse axis (12). The transverse axis (12) is preferably arranged in the front end region and in particular in the lower region. The sole holder carries two side jaws (17, 18) which are laterally outwardly pivotable about vertical axes (15, 16) disposed on both sides of the central longitudinal axis (14). A release spring (20) is housed in a hollow chamber (19) of the sole holder (13) and extends substantially in the direction of the central longitudinal axis (14). The release spring (20) generates, via a lever and cam track mechanism, a holding force for the inserted ski boot which biases both the side jaws (17, 18) and also the sole holder (13) towards the ski boot holding position. The side jaws (17, 18) are acted on, via two control levers which are journalled on the sole holder (13) about respective vertical axes (21, 22) and via a common yoke member (25) by one end of the release spring (20) which is braced at its other end on the sole holder (13). The release spring (20) also acts via the yoke member (25), after overcoming a clearance (26) which lies within the scope of different sole thicknesses of the ski boots to be inserted, on a hold-down cam (27) which is displaceably journalled in the sole holder (13) in the direction of the central longitudinal axis (14). This hold-down cam cooperates with a cam track (28) on the base body (11) which rises obliquely from the rear to the front.

10 Claims, 3 Drawing Sheets

SAFETY TOE UNIT FOR A SKI BINDING

Figure 1:
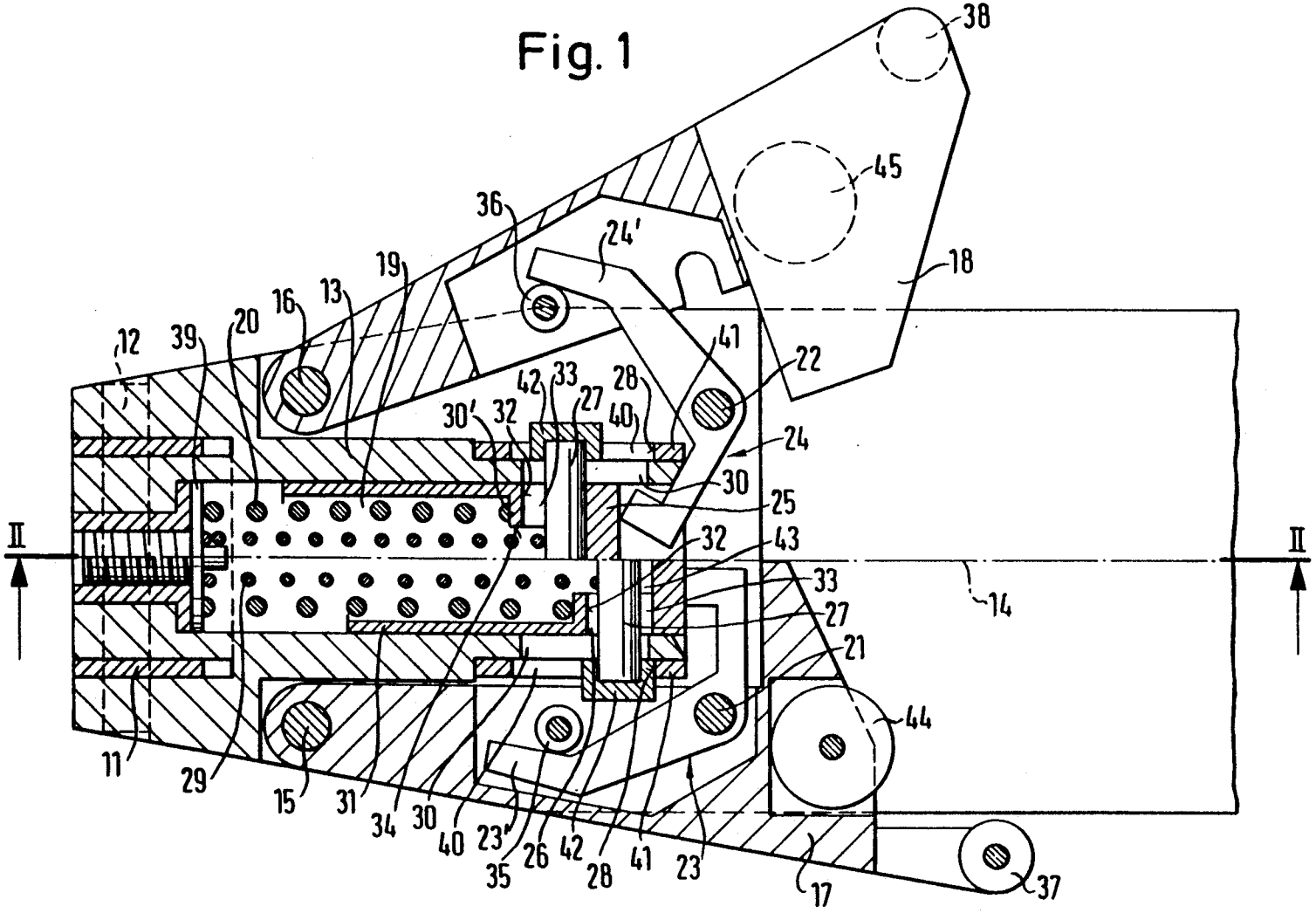

The invention relates to a safety toe unit for a ski binding comprising a base body which is to be secured to the ski, with a sole holder which holds an inserted ski boot from above and from the sides being upwardly pivotally mounted on the base body about a transverse axis which is preferably arranged in the front end region, and in particular in the lower region, and with the sole holder carrying two side jaws which are laterally outwardly pivotable about vertical axes disposed on both sides of the central longitudinal axis, wherein a release spring housed in a hollow chamber of the sole holder and extending substantially in the direction of the central longitudinal axis generates, via a lever and cam track mechanism, a holding force for the inserted ski boot which biases both the side jaws and also the sole holder towards their ski boot holding position.

It is already known to effect both sideways release and also vertical release with a safety toe unit of this kind by means of a single release spring (DE AS 26 37 870). The arrangement is however such that the one end of the release spring is responsible for the vertical release and the other end for the sideways release. With this arrangement neither of the ends of the release spring can be directly supported on the sole holder and this makes it difficult to change the spring bias of the release spring for the purpose of adjusting the hardness of the release setting. Moreover, the sole holder of the known toe unit must be precisely adjusted to match a specific sole of a ski boot so that jamming of the sole of the ski boot does not lead to an undesired change of the release behaviour.

The principal object underlying the present invention is to provide a safety toe unit for a ski binding of the initially named kind in which one end of the release spring is directly supported, and preferably adjustably supported, on the sole holder, while the other end can load both the sideways release mechanism and also the vertical release mechanism, with the troublefree lateral holding of an inserted ski boot not being impaired by different ski boot sole thicknesses, and indeed without special vertical adjustment means requiring hand actuation having to be provided on the sole holder.

In order to satisfy this object the present invention provides a safety toe unit of the initially named kind but characterised in that the side jaws are acted on via two control levers which are journalled on the sole holder about respective vertical axes, and via a common yoke member, by one end of the release spring which is braced at its other end on the sole holder; and in that the release spring also acts via the yoke member, after overcoming a clearance which lies within the scope of different sole thicknesses of the ski boots to be inserted, on a hold-down cam which is displaceably journalled in the sole holder in the direction of the central longitudinal axis and which cooperates with a cam track on the base body, the cam track rising obliquely from the rear to the front.

Thus, in accordance with the invention, the release spring acts via a yoke member directly and without play on the control lever of the side jaws. The action on the hold-down cam however only takes place after overcoming a predetermined clearance so that ski boots with different sole thicknesses lying within this clearance can be inserted into the binding. With this arrangement the sole holder automatically displaces itself in the vertical direction without the sideways holding force acting on the side jaws from the release spring being impaired.

Only when the predetermined clearance has been overcome during a vertical movement of the sole holder by the hold-down cam sliding along the inclined cam track is the hold-down cam directly loaded by the release spring via the yoke member so that from this instant on a normal vertical release of the safety binding takes place.

An auxiliary spring is preferably provided so that the sole of the ski boot is held in the rest position of the binding with a predetermined clamping force by the sole holder independently of its thickness. For this purpose an embodiment of the invention is preferably characterised in that the hold-down cam is tensioned against the cam track by an auxiliary spring which provides the clamping force for the sole of the ski boot.

The invention thus differentiates between the clamping force for the sole of the ski boot, which for example lies in the order of magnitude of 300 N, and the vertical release force which for example mounts to 800 N.

The side jaws themselves preferably have projections which hold down the sole of the ski boot. It is, however, also conceivable for the side jaws only to clamp the ski boot from the sides, whereas a special fixed hold-down element is provided on the vertically upwardly pivotable sole holder.

A particularly preferred constructional embodiment is characterised in that the hold-down cam is formed as a bar which extends transversely through elongate holes in the side walls of the sole holder.

It is particularly advantageous with this arrangement if a small clearance is present between the yoke member and the hold-down cam at the side opposite to the aforementioned clearance, in such a way that on inserting a ski boot into the binding the light pressing apart of the two side jaws and the pushing forward of the yoke member which may take place does not lead to the yoke member also contacting the hold-down cam. In this way the hold-down is now as previously in fixed contact with the cam track as a result of the loading by the auxiliary spring.

A particularly preferred embodiment for realizing the aforementioned small spacing is characterised in that the hold-down cam has a small clearance from the yoke not only at the side on which the release spring acts but also at the opposite side such that when a ski boot is inserted and without a sideways release, the hold-down cam is not lifted from the cam track.

The yoke member advantageously merges at the front into a spring abutment pot which is displaceably arranged in the direction of the central longitudinal axis of the toe unit in the hollow chamber which accommodates the release spring. Thus, the yoke member and the spring abutment pot are united into a single one-piece component with the rear end of the spring abutment pot simultaneously forming the abutment surface of the yoke member which acts on the hold-down cam from the front. That is to say the rear end of the spring abutment pot lies opposite to the hold-down cam via the clearance.

A particularly advantageous construction realization of the journalling of the hold-down cam is obtained when the hold-down cam is arranged in the rest position with play to the front and to the rear in lateral elongate holes of the component composed by the yoke member and the spring abutment pot, which is preferably a one-piece component.

A particular expedient arrangement of the auxiliary spring, which is preferably formed as a compression coil-spring in the same way as the release spring, is obtained when a central bore is provided within the base of the spring abutment pot which supports the release spring for the passage of the auxiliary spring. The auxiliary spring passes through this central bore to the hold-down cam, and is preferably arranged coaxially within the release spring. This arrangement is of straightforward design and compact.

A preferred constructional arrangement of the control levers is characterised the latter extend in the rest position substantially perpendicular to the central longitudinal axis laterally outwardly up to the pivot axis and from there obliquely forwardly to abutments secured to the side jaws, where they merge into engagement end pieces extending essentially in the direction of the central longitudinal axis.

Finally, a particularly preferred embodiment is characterised in that the support surfaces of the side holding elements extend obliquely inwardly from the bottom to the top in such a way that during a sideways release a vertically upwardly directed force component is also exerted on the sole holder.

This embodiment brings the advatange that in the case of a sideways release an upwardly directed force component is also exerted on the sole holder which counteracts jamming of the sole of the ski boot between the sole clamp and the ski during a sideways release. Even independently of the other features of the invention this embodiment is basically of advantage with all the safety ski bindings in which laterally pivotable side jaws are arranged on an upwardly pivotable sole holder.

Figure 4:
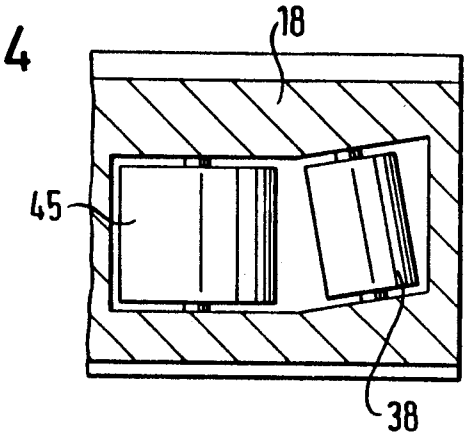
Figure 2:
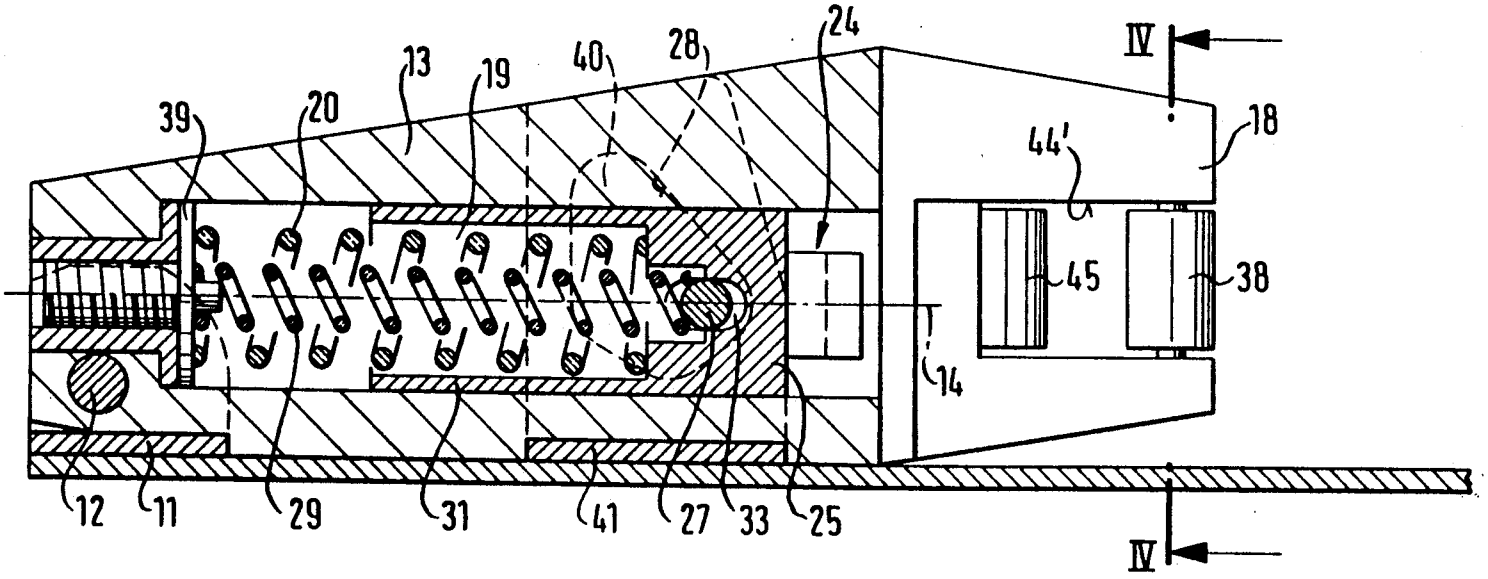
Figure 3:
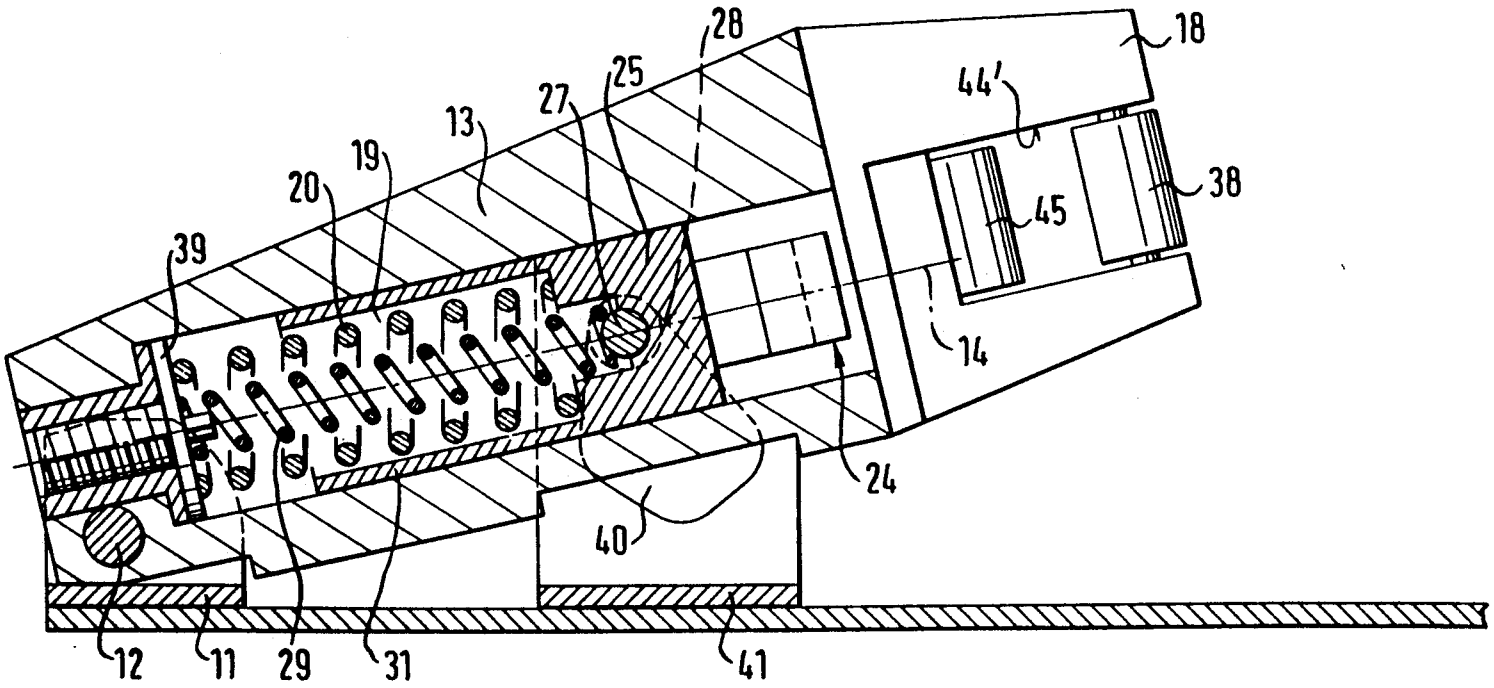

The invention will now be described in more detail in the following by way of example and with reference to the drawing in which are shown:

FIG. 1 a partly sectioned plan view of a safety toe unit in accordance with the invention, with the binding being shown in the rest position beneath the central longitudinal axis 14 and in the laterally released position above the central longitudinal axis 14, FIG. 2 a section on the line II—II in FIG. 1, but with the right hand side jaw 18 being shown in the non-released position, FIG. 3 a similar view to FIG. 2 with the sole holder in the upper release position, and FIG. 4 a section on the line IV—IV in FIG. 4 with a particularly preferred embodiment of the lateral holding rollers 38 being shown.

In accordance with the drawings the safety toe unit for a ski binding in accordance with the invention has a base body 11 which is to be secured to a ski, with a sole holder 13 being upwardly pivotally mounted on the base body 11 about a transverse axle 12.

Side jaws 17, 18 which can be pivoted laterally outwardly are hinged on the sole holder 13 on both sides of the central longitudinal axis 14 about vertical axes defined by pivot axles 15, 16. The engaging end pieces 23', 24' of control levers 23, 24 engage behind abutments 35, 36 which extend perpendicularly away from the side jaws at a distance from the vertical pivot axles 15, 16. The control levers are pivotally journalled about the vertical axes in the form of pivot axles 21, 22 on the sole holder 13. The arms of the control levers 23, 24 which extend from the pivot axles 21, 22 inwardly towards the central longitudinal axis 14 are loaded by a disc-shaped yoke member 25 which merges towards the front into a spring abutment pot 31 which is formed in one-piece with it. The spring abutment pot 31 is displaceably arranged in the direction of the central longitudinal axis 14 in a hollow chamber 19 of the sole holder 13 which extends in the direction of the central longitudinal axis 14. The spring abutment pot 31 has a base 30' having a central bore 34 and a release spring 20 is braced at the front against this base 30' with the front end of the release spring being braced against an axially displaceable abutment 39 of the sole holder 13.

The one-piece component comprising the spring abutment pot 31 and the yoke member 25 has an aperture which extends transversely through the rear part in the manner of elongate holes 34 through which a hold-down cam 27 formed in the shape of a bar extends transversely, with the hold-down cam being loaded from the front by an auxiliary spring formed as compression coil-spring. The auxiliary spring is braced against the same front spring abutment 39 as the release spring 20 and extends through the central bore 34 in the base 30' of the spring abutment pot 31. In this way the bar-like hold-down cam 27 is pressed against the rear edge of the elongate hole-like aperture 33.

The bar-like hold-down cam 27 extends at positions adjacent the elongate hole-like aperture 33 at both ends through elongate holes 30 in the side walls of the sole holder 13 which extend in the direction of the central longitudinal axis 14 and then into respective cam track recesses 40 of two vertically upright side plates 41 of the base body 11. In this region the hold-down cam 27 has sliding elements 42 which, in the passive rest position of the binding, are in contact at the rear against a cam track 28 of the side plate 41. The cam track 28 extends obliquely from the rear to the front in accordance with FIGS. 2 and 3. The cam track recess 40 is made so large that the sideways release in accordance with the upper half of FIG. 1 is not hindered by abutment of the hold-down cam 27 against the edges of the cam track cutout.

It is important that a clearance 26 is present in the passive rest position of the binding in accordance with the lower half of FIG. 1 between the rear end of the spring abutment pot 31, which forms the front abutment surface for the yoke member 25, and the front edge of the bar-like hold-down cam 27. In corresponding manner, on the opposite side of the hold-down cam 27 a small distance 43 should be present between the latter and the yoke member. An undesired mutual influence of the vertical and sideways release mechanisms on insertion of a ski boot into the binding is effectively avoided by the clearance 26 and by the small spacing 43. Front support rollers 44, 45 are provided on the side jaws 17, 18 in order to support the ski boot sole from the front. The central axes or pivot axles of the support rollers 44, 45 are arranged laterally slightly outside of the vertical axes 15, 16 so that during rearward falls a small opening effect is exerted on the side jaws.

Furthermore, lateral holding rollers 37, 38 are provided on the side jaws 17, 18 in the area of the rear end, and the sole of the inserted ski boot is also supported at the sides by these rollers 37, 38. Moreover, the side jaws 17, 18 extend over an inserted ski boot sole at 44 in order to securely hold the latter from the top.

In FIG. 4 the lateral holding rollers 37, 38 are arranged so they converge obliquely from the bottom towards the top so that during a sideways release the ski boot sole also exerts a small force component on the sole holder 13 in the vertical direction.

The manner of operation of the described safety toe unit is as follows:

If a ski boot sole is inserted into the binding shown in its rest position in the lower half of FIG. 1 the two side jaws 17, 18 are spread slightly so that the yoke member 25 is displaced somewhat forwardly via the control levers 23, 24 while compressing the release spring 20. As a result of the spacing 43 which is selected to be of a suitable size no loading of the hold-down cam 27 takes place and the end pieces 42 of the hold-down cam are thus pressed now as previously by the auxiliary spring 29 against the lower end of the cam track 28.

If sideways release now occurs in accordance with the upper half of FIG. 1 then the relevant control lever 24 presses the yoke member 25 forwardly while overcoming the small spacing 43 whereupon the hold-down cam 27 is moved forwardly while compressing the auxiliary spring 29. The release spring 20 should thus be calculated so that the total release force is determined by the sum of the spring forces of the release spring 20 and of the auxiliary spring 29.

The construction of the invention also has the advantage that within the constraints of the small spacing 43 the binding also has a certain sideways elasticity within which a certain sideways movement of the side jaws 17, 18 is ensured without this immediately leading to sideways release. In the case of an upward release in accordance with FIG. 3 the end pieces 42 of the hold-down cam 27 slide upwardly along the cam track 28 with the hold-down cam 27 being first displaced forwardly while overcoming the clearance 26 until it contacts the boundary surface 32 of the yoke member 25. From now on it is not only the auxiliary spring 29 but rather also the release spring 20 which is compressed so that a normal vertical release takes place. An important further advantage of the invention results in the fact that with a release of the binding in one direction (sideways or vertical release) the release force in the other direction is zero.

I claim:

1. Safety toe unit for a ski binding comprising a base body (11) which is to be secured to the ski, with a sole holder (13) which holds an inserted ski boot from above and from the sides being upwardly pivotally mounted on the base body about a transverse axis, and with the sole holder carrying two side jaws (17, 18) which are laterally outwardly pivotable about vertical axes (15, 16) disposed on both sides of a central longitudinal axis (14), wherein a release spring (20) is housed in a hollow chamber (19) of the sole holder (13) and extends substantially in the direction of the central longitudinal axis, characterised in that the side jaws (17, 18) are acted on via first and second control levers which are journalled on the sole holder (13) about respective vertical axes (21, 22), and via a common yoke member (25), by one end of the release spring (20) which is braced at its other end on the sole holder (13); and in that the release spring (20) also acts via the yoke member (25) on a hold-down cam (27) after overcoming a clearance between the yoke member (25) and the hold-down cam (27), the hold-down cam being displaceably journalled in the sole holder (13) in the direction of the central longitudinal axis (14) and cooperating with a cam track (28) on the base body (11), the cam track rising obliquely from the rear to the front.

2. Toe unit in accordance with claim 1, characterised in that the hold-down cam (27) is tensioned against the cam track (28) by an auxiliary spring (29) which provides the clamping force for the sole of the ski boot.

3. Toe unit in accordance with claim 1, characterised in that the hold-down cam (27) is formed as a bar which extends transversely through elongate holes (30) in the side walls of the sole holder (13).

4. Toe unit in accordance with claim 3, characterised in that the hold-down cam (27) has a further clearance (43) from the yoke (25), not only at the side on which the release spring (20) acts but also at the opposite side, such that when a ski boot is inserted and without a sideways release, the hold-down cam (27) is not lifted from the cam track (28).

5. Toe unit in accordance with claim 1, characterised in that the yoke member (25) merges at the front into a spring abutment pot (31) which is displaceably arranged in the direction of the central longitudinal axis (14) in the hollow chamber (19) which accommodates the release spring (20).

6. Toe unit in accordance with claim 5, characterised in that the rear end of the spring abutment pot (31) lies opposite the hold-down cam (27) via the clearance (26).

7. Toe unit in accordance with claim 5, characterised in that the hold-down cam (27) is arranged in a rest position with play to the front and to the rear in lateral elongate holes (33) of a component comprising the yoke member (25) and the spring abutment pot.

8. Toe unit in accordance with claim 7, characterised in that a central bore (34) is provided within a base (30') of the spring abutment pot (31) which supports the release spring (20) for the passage of an auxiliary spring (29) arranged coaxially with the release spring (20).

9. Toe unit in accordance with claim 1, characterised in that each control lever (23, 24) extends in a rest position substantially perpendicular to the central longitudinal axis (14) laterally outwardly up to the pivot axis (21, 22) and from there obliquely forwardly to abutments (35, 36) secured to the side jaws (17, 18), where they merge into engagement end pieces (23', 24') extending essentially in the direction of the central longitudinal axis (14).

10. Toe unit in accordance with claim 1, characterised in that a support surface for each side holding element (37, 38) extends obliquely inwardly from the bottom to the top in such a way that during a sideways release a vertically upwardly directed force component is also exerted on the sole holder (13).

* * * * *